US005715722A

United States Patent [19]

Morley

[11] Patent Number: 5,715,722

[45] Date of Patent: Feb. 10, 1998

[54] PORTABLE SHEET METAL BRAKE SYSTEM

[76] Inventor: William E. Morley, 261 Villa Rd. Nanaimo, British Columbia, Canada, V9T 2P6

[21] Appl. No.: 719,246

[22] Filed: Sep. 24, 1996

[51] Int. Cl.[6] ..... B21D 5/04

[52] U.S. Cl. ..... 72/319; 269/228

[58] Field of Search ..... 72/319, 320, 323; 269/228

[56] References Cited

U.S. PATENT DOCUMENTS

| | | | |
|---|---|---|---|
| 709,283 | 9/1902 | Vollmer | 72/320 |
| 909,936 | 1/1909 | Rice | 72/320 |
| 2,438,319 | 3/1948 | Kilham | 72/319 |
| 4,084,803 | 4/1978 | Beekenkamp | 269/228 |

FOREIGN PATENT DOCUMENTS

| | | | |
|---|---|---|---|
| 348312 | 2/1922 | Germany | 72/320 |

*Primary Examiner*—Daniel C. Crane

[57] ABSTRACT

A new Portable Sheet Metal Brake System for facilitating bending of metal, more particularly sheet metal, at various angles up to ninety degrees in a simple, controlled, and accurate procedure while compact enough to be transported to remote working locations. The inventive device includes a side support member, a flat base member secured orthogonally to the lower portion of the side support member, a flat anvil member movably secured to the side support member, a retaining means secured to the side support member and the flat anvil member, and a bending means rotatably secured to one end of the flat base member for bending metal.

5 Claims, 3 Drawing Sheets

PORTABLE SHEET METAL BRAKE SYSTEM

BACKGROUND OF THE INVENTION

1. Field of the Invention

The present invention relates to Sheet Metal Brake Devices and more particularly pertains to a new Portable Sheet Metal Brake System for facilitating bending of metal, more particularly sheet metal, at various angles up to ninety degrees in a simple, controlled, and accurate procedure while compact enough to be transported to remote working locations.

2. Description of the Prior Art

The use of Sheet Metal Brake Devices is known in the prior art. More specifically, Sheet Metal Brake Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Sheet Metal Brake Devices include U.S. Pat. No. 5,099,671; U.S. Pat. No. 4,282,735; U.S. Pat. No. 4,566,304; U.S. Pat. No. 4,389,869; U.S. Pat. No. 4,352,382 and U.S. Pat. No. 4,237,716.

While these devices fulfill their respective, particular objectives and requirements, the aforementioned patents do not disclose a new Portable Sheet Metal Brake System. The inventive device includes a side support member, a flat base member secured orthogonally to the lower portion of the side support member, a flat anvil member movably secured to the side support member, a retaining means secured to the side support member and the flat anvil member, and a bending means rotatably secured to one end of the flat base member for bending metal.

In these respects, the Portable Sheet Metal Brake System according to the present invention substantially departs from the conventional concepts anti designs of the prior art, and in so doing provides an apparatus primarily developed for the purpose of facilitating bending of metal, more particularly sheet metal, at various angles up to ninety degrees in a simple, controlled, and accurate procedure while compact enough to be transported to remote working locations.

SUMMARY OF THE INVENTION

In view of the foregoing disadvantages inherent in the known types of Sheet Metal Brake Devices now present in the prior art, the present invention provides a new Portable Sheet Metal Brake System construction wherein the same can be utilized for facilitating bending of metal, more particularly sheet metal, at various angles up to ninety degrees in a simple, controlled, and accurate procedure while compact enough to be transported to remote working locations.

The general purpose of the present invention which will be described subsequently in greater detail, is to provide a new Portable Sheet Metal Brake System apparatus and method which has many of the advantages of the Sheet Metal Brake Devices mentioned heretofore and many novel features that result in a new Portable Sheet Metal Brake System which is not anticipated, rendered obvious, suggested, or even implied by any of the prior art Sheet Metal Brake Devices, either alone or in any combination thereof.

To attain this, the present invention generally comprises a side support member, a flat base member secured orthogonally to the tower portion of the side support member, a flat anvil member movably secured to the side support member, a retaining means secured to the side support member and the flat anvil member, and a bending means rotatably secured to one end of the flat base member for bending metal.

There has thus been outlined rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Portable Sheet Metal Brake System apparatus and method which has many of the advantages of the Sheet Metal Brake Devices mentioned heretofore and many novel features that result in a new Portable Sheet Metal Brake System which is not anticipated, rendered obvious, suggested, or even implied by any of the prior art Sheet Metal Brake Devices, either alone or in any combination thereof.

It is another object of the present invention to provide a new Portable Sheet Metal Brake System which may be easily and efficiently manufactured and marketed.

It is a further object of the present invention to provide a new Portable Sheet Metal Brake System which is of a durable and reliable construction.

An even further object of the present invention is to provide a new Portable Sheet Metal Brake System which is susceptible of a low cost of manufacture with regard to both materials and labor, and which accordingly is then susceptible of low prices of sale to the consuming public, thereby making such Portable Sheet Metal Brake System economically available to the buying public.

Still yet another object of the present invention is to provide a new Portable Sheet Metal Brake System which provides in the apparatuses and methods of the prior art some of the advantages thereof while simultaneously overcoming some of the disadvantages normally associated therewith.

Still another object of the present invention is to provide a new Portable Sheet Metal Brake System for facilitating bending of metal, more particularly sheet metal, at various angles up to ninety degrees in a simple, controlled, and accurate procedure while compact enough to be transported to remote working locations.

Yet another object of the present invention is to provide a new Portable Sheet Metal Brake System which includes a side support member, a flat base member secured orthogonally to the lower portion of the side support member, a flat anvil member movably secured to the side support member, a retaining means secured to the side support member and the flat anvil member, and a bending means rotatably secured to one end of the flat base member for bending metal.

Still yet another object of the present invention is to provide a new Portable Sheet Metal Brake System that bends metal, more particularly sheet metal, at precise angles in a controlled manner.

Even still another object of the present invention is to provide a new Portable Sheet Metal Brake System that is small enough to be carried to remote work locations thereby saving time and money.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
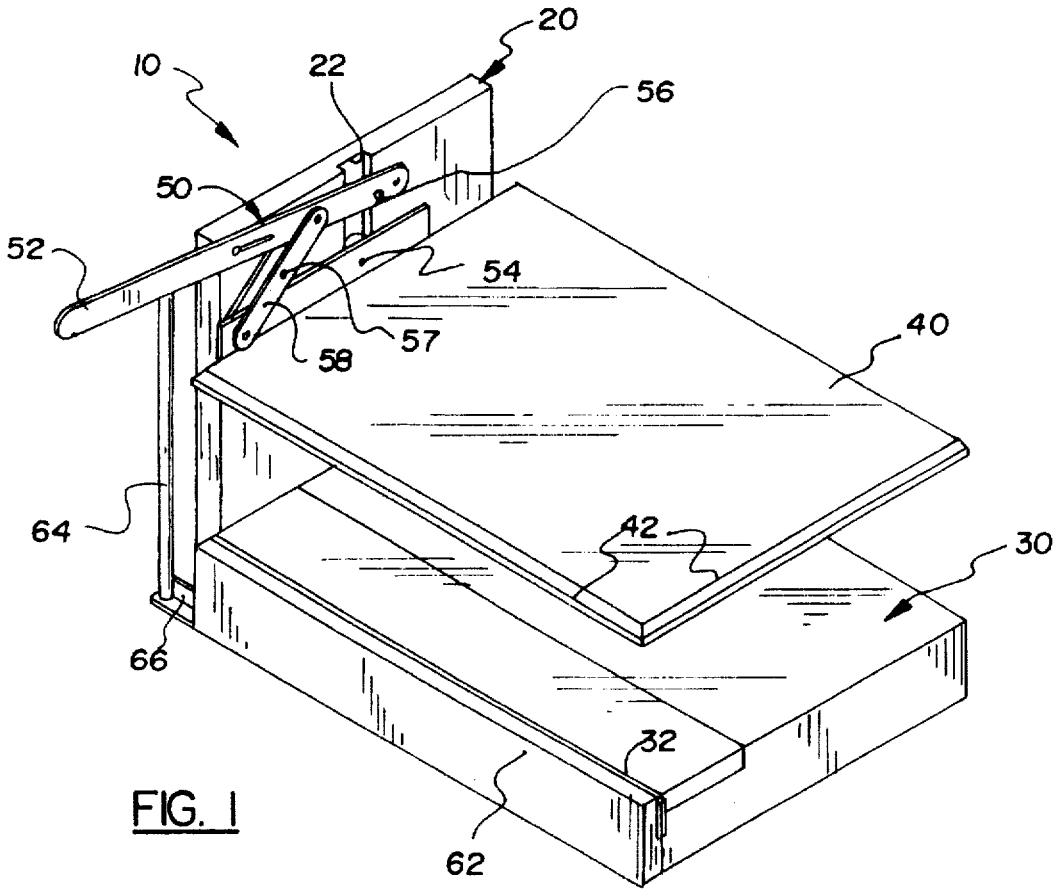
FIG. 1 is a right side perspective view of a new Portable Sheet Metal Brake System in the open position according to the present invention.

With reference now to the drawings and in particular to FIGS. 1 through 6 thereof, a new Portable Sheet Metal Brake System embodying the principles and concepts of the present invention and generally designated by the reference numeral 10 wilt be described.

More specifically, it will be noted that the Portable Sheet Metal Brake System 10 comprises a side support member 20 projecting vertically in relation to ground including a roller guide slot 22 projecting from the lower portion to the upper portion vertically near the middle section of the side support member 20, a flat base member 30 secured to the lower portion of the side support member 20 to form an L-shaped structure, where the flat base member 30 includes a central cavity 34 projecting into the central bottom portion, retaining means 50 rotatably secured to the upper portion of the side support member 20, a flat anvil member 40 secured to the retaining means 50 perpendicular to the side support member 20 and parallel to the flat base member 30, including a slanted edge 42 around the perimeter of the flat anvil member 40, and a bending means 60 rotatably secured to an end of the flat base member 30 adjacent to the side support member 20.

Figure 2:
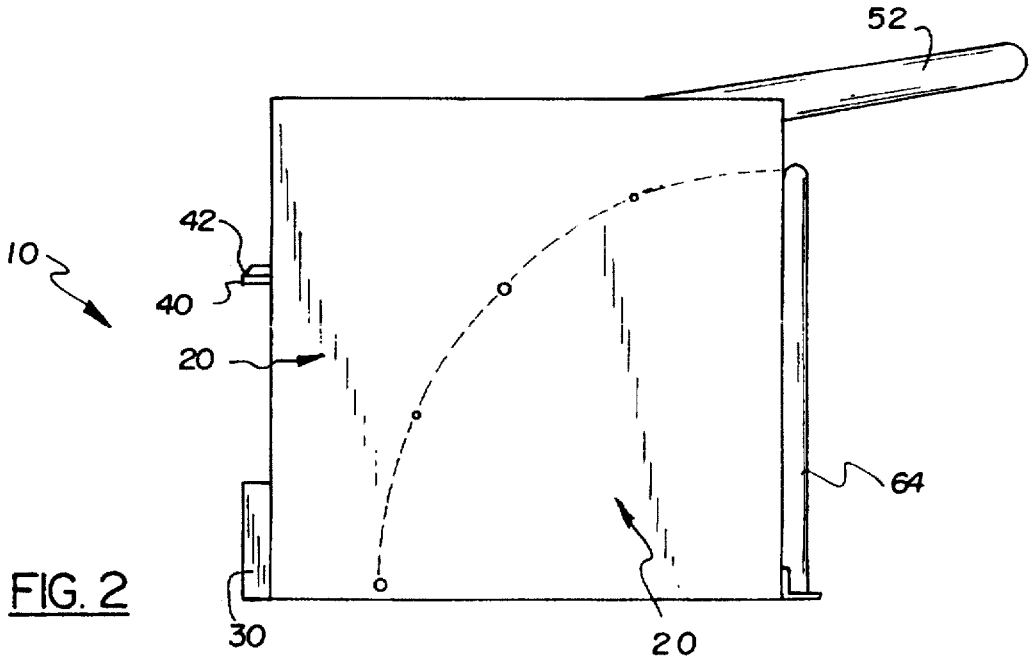
FIG. 2 is a side view thereof displaying the rotational motion of the bending pole.
Figure 3:
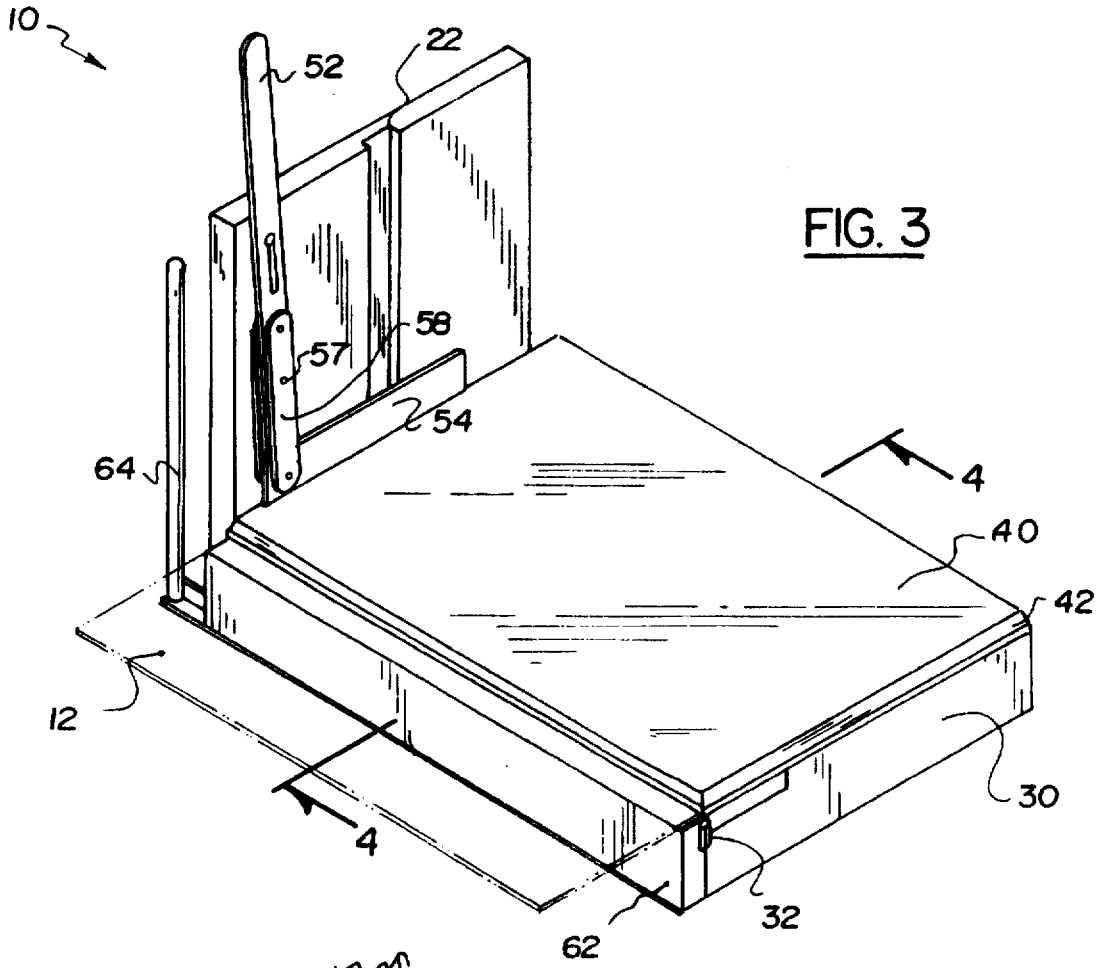
FIG. 3 is an upper right perspective view of the present invention in the closed position retaining a piece of sheet metal mesial the flat anvil member and the flat base member.
Figure 4:
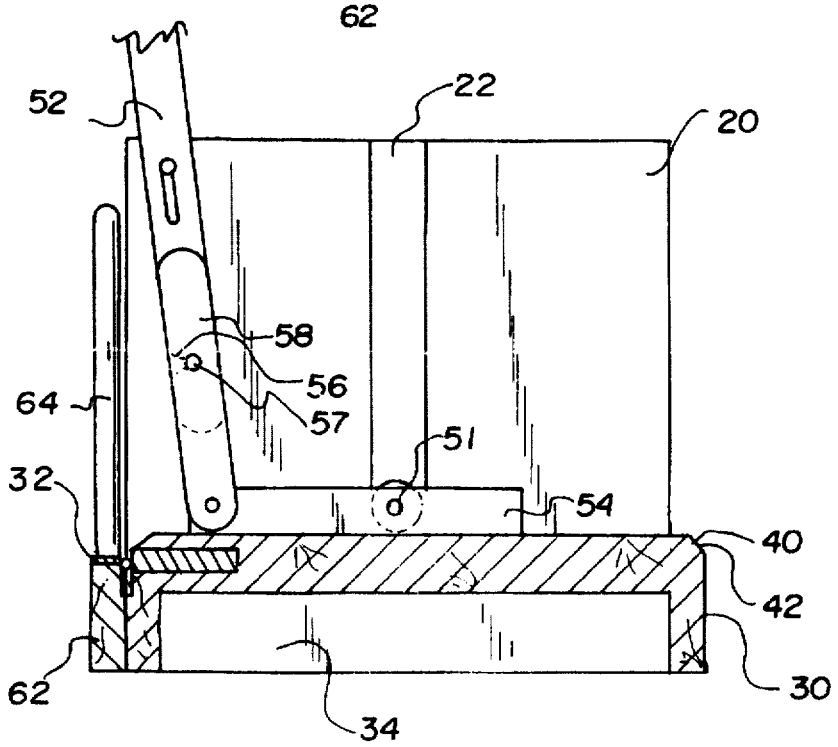
FIG. 4 is a cross sectional view taken along line 4—4 of FIG. 3 disclosing the retaining means and he bending means.
Figure 5:
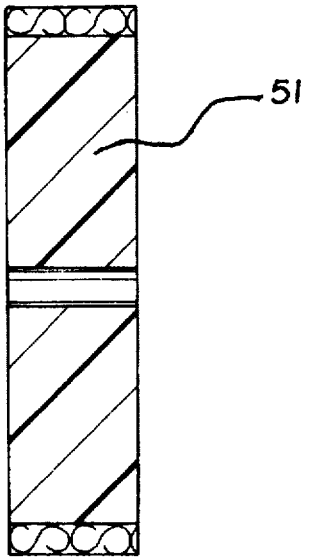
FIG. 5 is a cross sectional view taken along line 5—5 of FIG. 4 disclosing the roller.
Figure 6:
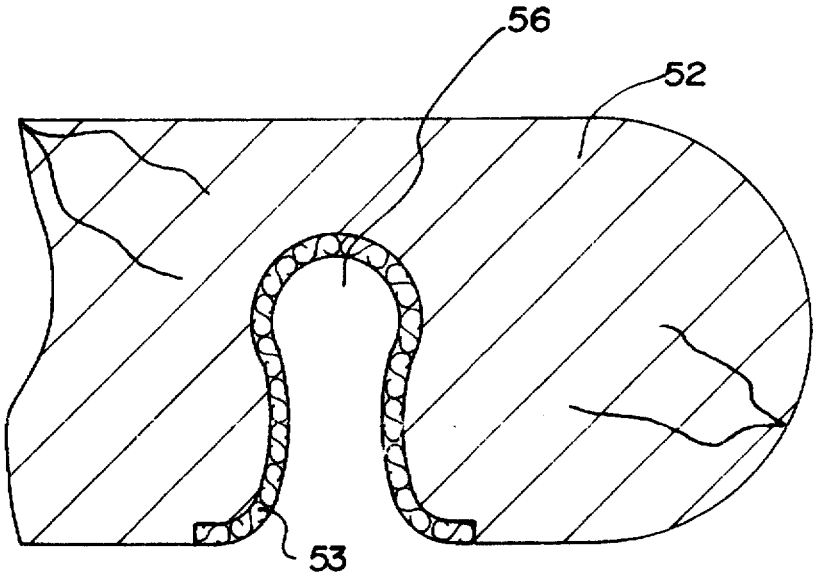
FIG. 6 is a magnified view of the cocking slot from FIG. 1.

As best illustrated in FIGS. 1 through 6, it can be shown that the retaining means 50 includes a main arm member 52 centrally rotatably secured to the upper portion of the side support member 20 near the bending means 60. The main arm member 52 includes a cocking slot 56 where the entrance is narrower than the resting area and where the cocking slot 56 is lined with a nylon layer 53 as best shown in FIG. 6 of the drawings. A secondary arm member 58 has one end rotatably secured to the main arm member 52 mesial the cocking slot 56 and the location of the rotational mounting point of the main arm member to the side support means as best shown in FIG. 4 of the drawings. The secondary arm member 58 further includes a cocking pin 57 projecting perpendicular from the central portion being captured by the cocking slot 56. An anvil engaging member 54 is parallelly secured to the top surface of the flat anvil member 40 as best shown in FIG. 3 of the drawings. The end of the secondary am, member 58 opposite of the main arm member 52 is rotatably secured to the anvil engaging member 54. A roller 51 is rotatably secured to the anvil engaging member 54 rotatably projecting into the roller guide slot 22 of the side support member 20. The bending means 60 includes an apron member 62 rotatably secured to the flat base member 30 adjacent to the side support member 20 by a metal hinge member 32. A bending pole 64 is orthogonally secured to an angle iron 66 which is secured to the end of the apron member 62 nearest the side support member 20 as best shown in FIG. 1 of the drawings. The surface of the side support member 20 opposite of the roller guide slot 22 preferably includes the precise angle of bend in relation to the bending pole's 64 range of motion displayed as shown in FIG. 2 of the drawings. The flat anvil member 40 and the flat base member 30 are preferably constructed from oak wood providing maximum strength in relation to weight.

In use, the user places a piece of sheet metal 12 mesial the flat anvil member 40 and the flat base member 30. The user then manually manipulates the end of the main arm member 52 opposite of the cocking slot 56 to as to force the flat anvil member 40 against the top surface of the sheet metal 12 so the sheet metal 12 is retained mesial the flat anvil member 40 and the flat base member 30. The user then manually rotates the bending pole 64 so as to rotate the apron member 62 against the sheet metal 12 thereby bending the sheet metal 12 until the desired angle is reached. The user then releases the retaining means 50 and removes the sheet metal 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable sheet metal brake system comprising a substantially rectangular and substantially flat base member for resting on a surface;

a side support member mounted to one end of said base member in a substantially perpendicular relationship to said base member, said side support member having a lower mounted portion mounted to said base member and an upper free portion opposite said mounted portion, said side support member having a roller guide slot therein extending from the lower mounted portion to the upper free portion;

a retaining means rotatably mounted on the upper free portion of the side support member;

a substantially flat anvil member secured to the retaining means, said anvil member being oriented substantially perpendicular to the side support member and substantially parallel to the flat base member, said anvil member having a perimeter edge slanted with respect to the substantially flat surfaces of the anvil member;

a bending means pivotally mounted on an end of the flat base member adjacent to the side support member;

wherein the retaining means includes:

a main arm member centrally rotatably secured to the upper free portion of the side support member at a rotational point for the main arm member, said main arm member having a cocking slot therein with an entrance into said cocking slot being narrower than an interior resting area within said cocking slot, wherein the edges defining said cocking slot are lined with a nylon layer;

a secondary arm member with one end rotatably secured to the main arm member between the cocking slot and the rotational point, the secondary arm member including a cocking pin projecting perpendicular from a central portion of said secondary arm member for being captured by the cocking slot in said main arm member;

an anvil engaging member secured in a parallel relationship to the top surface of the flat anvil member, wherein said anvil engaging member is rotatably connected to the end of the secondary arm member opposite of the end connected to the main arm member is; and a roller rotatably secured to the anvil engaging member and rotatably projecting into the roller guide slot of the side support member.

2. The portable sheet metal brake system of claim 1 wherein the bending means includes:

an elongate apron member having opposite ends and being hingedly secured to the flat base member adjacent to the side support member by a hinge member; and a bending handle orthogonally secured to the end of the apron member nearest the side support member.

3. The portable sheet metal brake system of claim 1 wherein the surface of the side support member opposite of the roller guide slot includes indicia thereon indicating the precise angle of bend produced by the apron member according to the position of the bending handle with respect to said indicia.

4. The portable sheet metal brake system of claim 1 wherein the flat anvil member and the flat base member are constructed from oak wood providing maximum strength in relation to weight.

5. A portable metal brake system comprising:

a base member for resting on a horizontal surface and having a substantially rectangular and substantially flat upper surface;

a side support member mounted on one end of said base member in a substantially perpendicular relationship to the upper surface of said base member, said side support member having a lower portion mounted on said base member and an upper portion opposite said lower portion, said side support member having a substantially vertically oriented roller guide slot therein extending from the lower portion to the upper portion;

a substantially flat anvil member oriented substantially perpendicular to said side support member and substantially parallel to the upper surface of said base member, said anvil member being movable between a position adjacent to the upper surface of said base member and a position spaced from the upper surface of said base member;

a bending apron pivotally mounted on an end of the flat base member adjacent to said side support member; and a retaining assembly pivotally mounted on the upper portion of the side support member; said retaining assembly including an elongate main arm member pivotally mounted to the upper portion of the side support member at a central location on said main arm member, said main arm member having a cocking notch therein, said cocking notch having an entrance portion and an interior portion, the entrance portion of said cocking slot being narrower than the interior portion of said cocking slot;

an elongate secondary arm member having one end pivotally mounted on said main arm member at a location on said main arm member between the cocking slot and the location of the pivotal mounting to said side support member, said secondary arm member including a cocking pin projecting perpendicularly from a central portion of said secondary arm member for being captured by the cocking slot in said main arm member;

an elongate anvil engaging member secured in a parallel relationship to a top surface of the flat anvil member, said anvil engaging member is pivotally mounted on the end of the secondary arm member opposite of the end of said secondary arm member mounted on the main arm member; and a roller rotatably mounted on the anvil engaging member and extending into the roller guide slot of said side support member.

* * * * *